US007794247B2

(12) United States Patent
Suzuki

(10) Patent No.: US 7,794,247 B2
(45) Date of Patent: Sep. 14, 2010

(54) LEVER LOCK TYPE CONNECTOR

(75) Inventor: Sachio Suzuki, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 36 days.

(21) Appl. No.: 12/232,394

(22) Filed: Sep. 16, 2008

(65) Prior Publication Data

US 2009/0075506 A1 Mar. 19, 2009

(30) Foreign Application Priority Data

Sep. 18, 2007 (JP) ..... 2007-240376

(51) Int. Cl.
*H01R 13/62* (2006.01)

(52) U.S. Cl. ..... 439/157

(58) Field of Classification Search ..... 439/157, 439/152, 160, 372
See application file for complete search history.

(56) References Cited

U.S. PATENT DOCUMENTS 5,178,553 A * 1/1993 Hatagishi et al. ..... 439/157
5,230,635 A * 7/1993 Takenouchi et al. ..... 439/157
5,344,194 A * 9/1994 Hatagishi et al. ..... 285/26
5,474,462 A * 12/1995 Yamanashi ..... 439/157
5,476,391 A * 12/1995 Katsuma ..... 439/157
5,484,297 A * 1/1996 Takahashi et al. ..... 439/157
5,551,885 A * 9/1996 Yamanashi et al. ..... 439/157
6,439,902 B1 * 8/2002 Cole et al. ..... 439/157
6,644,992 B2 * 11/2003 Maegawa ..... 439/157
6,755,674 B2 * 6/2004 Fujii et al. ..... 439/157
6,916,135 B2 * 7/2005 Tanaka ..... 403/322.4
7,258,557 B2 * 8/2007 Matsubara et al. ..... 439/157
7,419,390 B2 * 9/2008 Ohtaka et al. ..... 439/157
7,431,598 B2 * 10/2008 Ikeya et al. ..... 439/160
7,442,058 B2 * 10/2008 Ohtaka et al. ..... 439/157
7,537,469 B2 * 5/2009 Takahashi et al. ..... 439/157
2002/0025704 A1 * 2/2002 Takata ..... 439/157
2003/0022539 A1 * 1/2003 Takahashi ..... 439/157
2007/0184692 A1 * 8/2007 Ohtaka et al. ..... 439/157
2008/0102667 A1 * 5/2008 Ikeya et al. ..... 439/157
2009/0023316 A1 * 1/2009 Takahashi et al. ..... 439/157

FOREIGN PATENT DOCUMENTS

JP 2006-331996 12/2006

* cited by examiner

*Primary Examiner*—T C Patel
*Assistant Examiner*—Harshad C Patel
(74) *Attorney, Agent, or Firm*—McGinn IP Law Group, PLLC

(57) ABSTRACT

A lever lock type connector includes a pair of outer housings including connecting terminals for an electrical connection, the pair of outer housings being joined each other by a rotating operation of a rotating lever in a state that the rotating lever rotatably supported by one of the pair of outer housings is engaged with an engaging portion of an other of the pair of outer housings, and a locking member that is provided on the one of the pair of outer housings and movable towards a sidewall of the other of the pair of outer housings. The locking member is adapted to move towards the sidewall of the other of the pair of outer housings in conjunction with the rotating operation of the rotating lever so as to contact the sidewall of the other of the pair of outer housings.

6 Claims, 8 Drawing Sheets

LEVER LOCK TYPE CONNECTOR

The present application is based on Japanese Patent Application No. 2007-240376 filed on Sep. 18, 2007, the entire contents of which are incorporated herein by reference.

BACKGROUND OF THE INVENTION

1. Field of the Invention

The present invention relates to a connector with a vibration-proofing structure and, in particular, to a lever lock type connector that a pair of connector housings can be joined by turning a lever.

2. Related Art

FIG. 8 shows a structure of a conventional connector used for electrical connection among a battery, an inverter and a motor, which is a hybrid system for a hybrid car. A male outer housing 1 surrounds a male inner housing 5, furthermore, the male inner housing 5 surrounds a male terminal 4. Furthermore, an engaging projection 1*a* is provided on both sidewalls of the male outer housing 1.

In the same way, a female outer housing 2 surrounds a female inner housing (not shown), furthermore, the female inner housing (not shown) surrounds a female terminal (not shown). Furthermore, arm portions 3*b* of a rotating lever 3 substantially U-shaped are opposed and one end of the both arm portions 3*b* is rotatably supported on both side surfaces of the female outer housing 2. A groove portion 3*a* engaging with the engaging projection 1*a* and an loading slot 3*d* are provided on the both arm portions 3*b* of the rotating lever 3. The loading slot 3*d* and the groove portion 3*a* are connected to each other.

In this structure, the engaging projection 1*a* is inserted into the loading slot 3*d* and temporarily fitted to the both outer housings 1 and 2. And, the engaging projection 1*a* moves along the groove portion 3*a* by turning the rotating lever 3, and then, the both outer housings 1 and 2 are completely fitted together. At the same time, the male terminal 4 and the female terminal (not shown) are connected to each other inside the both outer housings 1 and 2.

There is a conventional connector in which both outer housings 1 and 2 are formed of aluminum for giving electromagnetic wave blocking function. In this type, it is necessary to provide a certain degree of clearance between the outer housings 1 and 2 to prevent failure in fitting due to mutual interference between the outer housings 1 and 2, and in consideration of a variation in size in manufacturing the outer housings 1 and 2.

However, when this connector is used in an engine room of a vehicle which is subjected to vibration, backlash occurs due to the vibration between the outer housings 1 and 2. A contact portion (not shown) between the male terminal 4 and the female terminal (not shown) provided inside the outer housings is repeatedly rubbed each other. Thus, a problem arises that tin or silver plating is abraded at the contact portion, a copper base is thereby exposed and oxidized, and the contact portion of the male terminal 4 and the female terminal increases in resistance.

Therefore, a connector as shown in FIG. 9 is used for solving the above problem (See, for example, JP-A-2006-331996). This connector 100 is formed by joining a male connector housing 110 to a female connector housing 141. The male connector housing 110 is composed of an outer housing 112, an inner housing 113, and a locking lever 117. The outer housing 112 is separated from the inner housing 113 and provided with the locking lever 117. The inner housing 113 is biased by a coil spring 116 provided between the inner housing 113 and the outer housing 112, and contacts the female connector housing 141. A backlash between the female connector housing 141 holding a male terminal (not shown) and the inner housing 113 holding a female terminal (not shown) is prevented by this structure. As a result, it is possible to prevent abrasion at the contact portion between the connecting terminals (not shown).

However, in the connector as described in JP-A-2006-331996, since elastic force by the coil spring acts in a direction for separating the connectors, a problem arises that operability for joining the connector housings together lowers. In addition, although the backlash can be reduced in the joining direction of the connector housings, other backlash cannot be sufficiently reduced in a direction orthogonal to the joining direction of the connector housings. Thus, backlash between the male and female terminals can occur in the direction orthogonal to the joining direction, so that abrasion between the terminals cannot be eliminated completely.

THE SUMMARY OF THE INVENTION

It is an object of the invention to provide a lever lock type connector that vibration resistance can be improved without increasing the size of the connector and lowering operability for joining its connector housings together.

(1) According to one embodiment of the invention, a lever lock type connector comprises:

a pair of outer housings comprising connecting terminals for an electrical connection, the pair of outer housings being joined each other by a rotating operation of a rotating lever in a state that the rotating lever rotatably supported by one of the pair of outer housings is engaged with an engaging portion of an other of the pair of outer housings; and a locking member that is provided on the one of the pair of outer housings and movable towards a sidewall of the other of the pair of outer housings, wherein the locking member is adapted to move towards the sidewall of the other of the pair of outer housings in conjunction with the rotating operation of the rotating lever so as to contact the sidewall of the other of the pair of outer housings.

(2) According to another embodiment of the invention, a lever lock type connector comprises:

a pair of outer housings comprising connecting terminals for an electrical connection, wherein one of the pair of outer housings comprises a rotating lever including a groove portion and rotatably supported by the one of the outer housings, an other of the pair of outer housings comprises an engaging projection portion engageable with the groove portion, and the pair of outer housings are joined each other by a rotating operation of the rotating lever in a state that the engaging projection portion is engaged with the groove portion; and a locking member that is provided on the one of the pair of outer housings and movable towards a sidewall of the other of the pair of outer housings, wherein the locking member is adapted to move towards the sidewall of the other of the pair of outer housings in conjunction with the rotating operation of the rotating lever so as to contact the sidewall of the other of the pair of outer housings.

In the above embodiments (1) and (2), the following modifications and changes can be made.

(i) The rotating lever is rotatably supported by the one of the pair of outer housings via a connecting member including the locking member, a male threaded portion is formed on a surface of the locking member, a female threaded portion screwing together with the male threaded portion is formed on a connecting hole provided on a sidewall of the one of the pair of outer housings, and the locking member is adapted to be threaded into the connecting hole and to move towards the sidewall of the other of the pair of outer housings in conjunction with the rotating operation of the rotating lever so as to contact the sidewall of the other of the pair of outer housings.

(ii) The connecting member comprises a projecting member integrated therewith, the rotating lever including a lever hole into which the projecting member is inserted, and the projecting member and the lever hole are shaped such that the connecting member rotates in conjunction with the rotating operation of the rotating lever.

(iii) The locking member comprises an elastic member at a part where it contacts the sidewall of the other of the pair of outer housings.

In the embodiments of the invention, by turning only the rotating lever, locking force can be effected in a direction toward the outer housings from the lateral sides of the connector. Therefore, backlash can be effectively prevented in a direction orthogonal to the joining direction of the connector housings without increasing the number of steps for joining the connector housings together.

In other words, without increasing the contact force (or insertion force) between the male and female terminals inside the outer housings, abrasion between the male and female terminals due to vibration can be prevented. Thus, the joining operation can be easy conducted without increasing the size of the rotating lever as a toggle mechanism.

The locking member may be provided with an elastic member at a part for contacting the lateral side of the other outer housing. Thereby, the vibration resistance of the connector can be further enhanced.

BRIEF DESCRIPTION OF THE DRAWINGS

Next, the present invention will be explained in more detail in conjunction with appended drawings, wherein.

DESCRIPTION OF THE PREFERRED EMBODIMENTS

First Embodiment

The first preferred embodiment according to the present invention will be explained in detail referring to FIG. 1 to FIG. 5.

Figure 1:
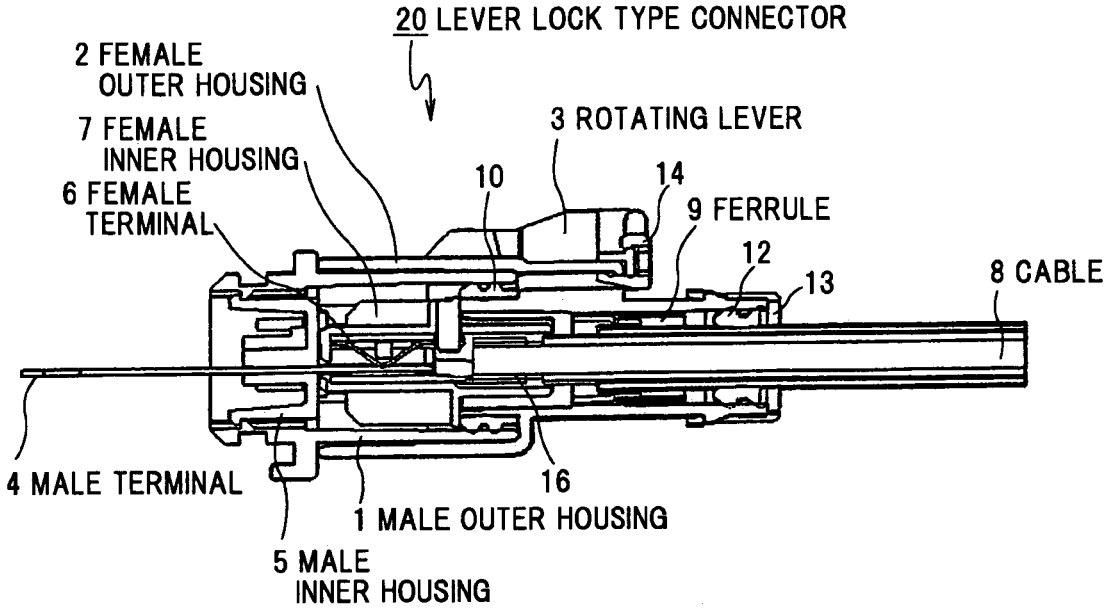
FIG. 1 is a longitudinal sectional view of a lever lock type connector in a preferred embodiment according to the present invention.

FIG. 1 shows the cross sectional structure of a lever lock type connector 20 in the first embodiment when being joined. The lever lock type connector 20 is composed of a male outer housing 1, and a female outer housing 2 engageable with the male outer housing 1. A device-side connector having the male outer housing 1 is attached to a device (not shown), and a cable-side connector having the female outer housing 2 is attached to a cable 8.

The device-side connector has a structure that a male inner housing 5 of an insulating resin is fixed to the outer periphery of a male terminal 4 having a tab terminal structure, and the male inner housing 5 is fixed to the male outer housing 1 of aluminum.

The cable-side connector has a structure that a female inner housing 7 of an insulating resin is fixed to the outer periphery of a female terminal 6 having an RECE contact structure and the female inner housing 7 is fixed to the female outer housing 2 of aluminum.

Furthermore, the cross section of the female terminal 6 arranged in the female outer housing 2 is V-shaped. Elastic force is generated by being thus V-shaped, and it is possible to keep contact between the female terminal 6 and the male terminal 4 arranged in the male outer housing 1 at constant force.

The cable 8 has a structure that around a conductor, an insulating resin, a shield and a sheath are sequentially formed in a concentric circle shape. The conductor of the cable 8 is exposed at a tip end of the cable 8 on the female terminal 6 side, tightened by a barrel portion 16 provided on the female terminal 6, and electrically connected to the female terminal 6.

Furthermore, the shield is electrically connected to the female outer housing 2 via a ferrule 9.

A waterproof packing 10 is provided on the cable-side connector, and the waterproof property between the outer housings 1 and 2 can be obtained by pressing the packing 10 from the outer housings 1 and 2 when joining them.

Furthermore, a waterproof packing 12 and a tail plate 13 for securing the waterproof packing 12 are provided between the cable 8 and the female outer housing 2, so that the waterproof property between the cable 8 and the female outer housing 2 can be obtained.

Figure 2A:
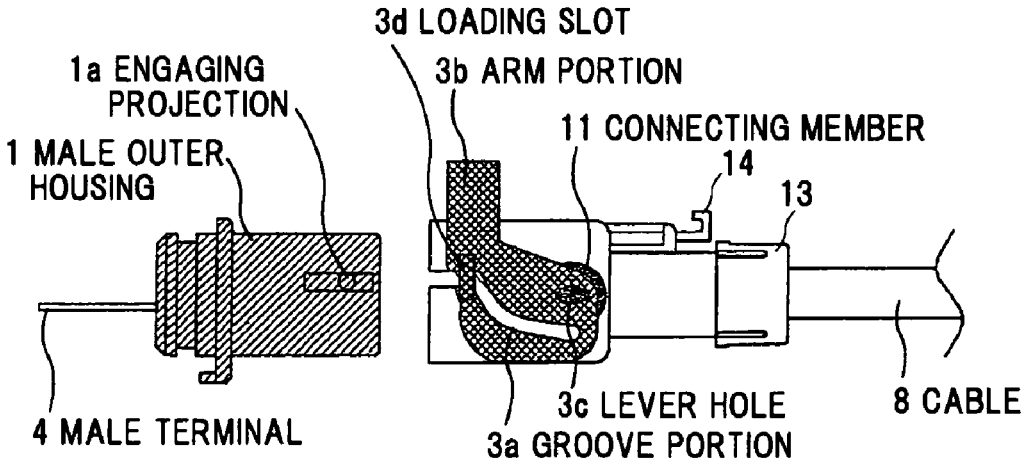
FIG. 2A is a side view showing a state of the lever lock type connector of FIG. 1 before joining male and female outer housings together.
Figure 2B:
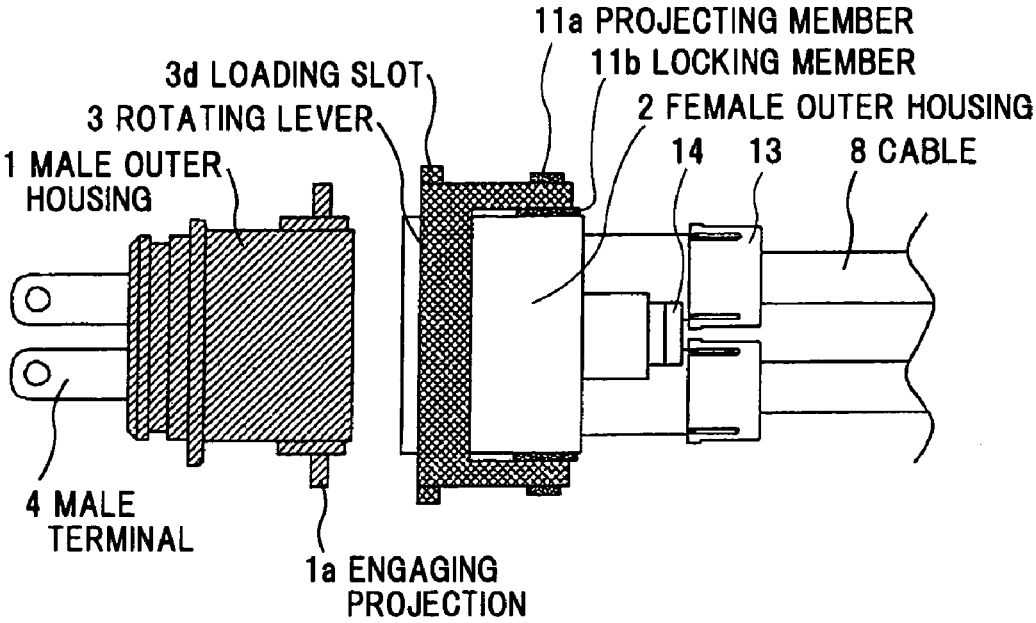
FIG. 2B is a top view showing the state of the lever lock type connector of FIG. 1 before joining the male and female outer housings together.

FIGS. 2A and 2B show the connector before the joining, where FIG. 2A is a side view and FIG. 2B is a top view. The rotating lever 3 substantially U-shaped is rotatably supported by the female outer housing 2 via a connecting member 11 composed of a projecting member 11*a* and a locking member 11*b*. The rotating lever 3 is composed of an elliptical lever hole 3*c* on an arm portion 3*b* and a groove portion 3*a* engaged with the engaging projection 1*a* as an engaging portion described later, and the groove portion 3*a* includes an loading slot 3*d*. The connecting member 11 is provided with the elliptical projecting member 11*a*. The connecting member 11 rotates in conjunction with the rotating operation of the rotating lever 3 by fitting the projecting member 11*a* into the lever hole 3*c*. Here, the lever hole 3*c* and the projecting member 11*a* are not limited to the elliptical shape, and they may be arbitrarily formed if only the connecting member 11 can be rotated in accordance with the rotating operation of the rotating lever 3. For example, they may be formed a triangle, a square or a polygon except a circle. However, the connection of the arm portion 3*b* with the connecting member 11 does not restrict the movement of the connecting member 11 in its axial direction.

Figure 3A:
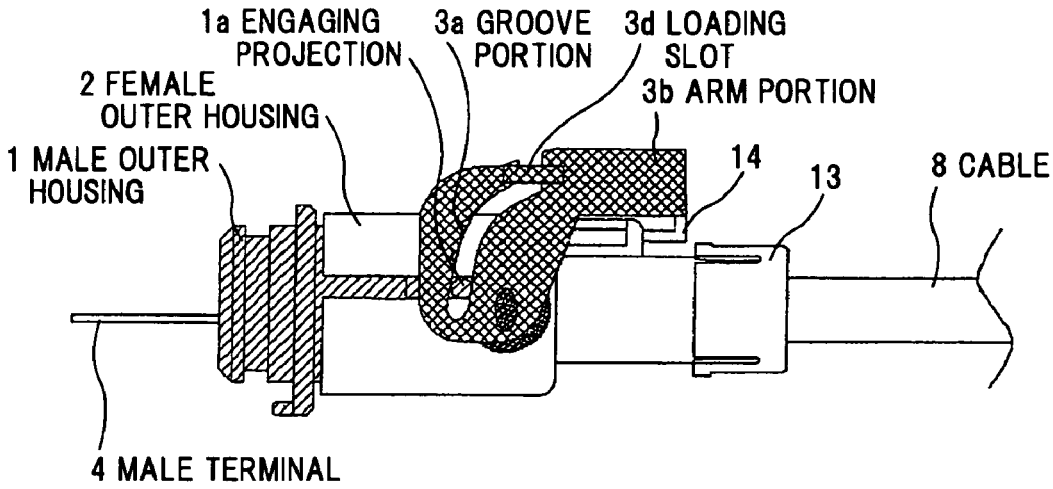
FIG. 3A is a side view showing a state of the lever lock type connector of FIG. 1 after joining the male and female outer housings together.
Figure 3B:
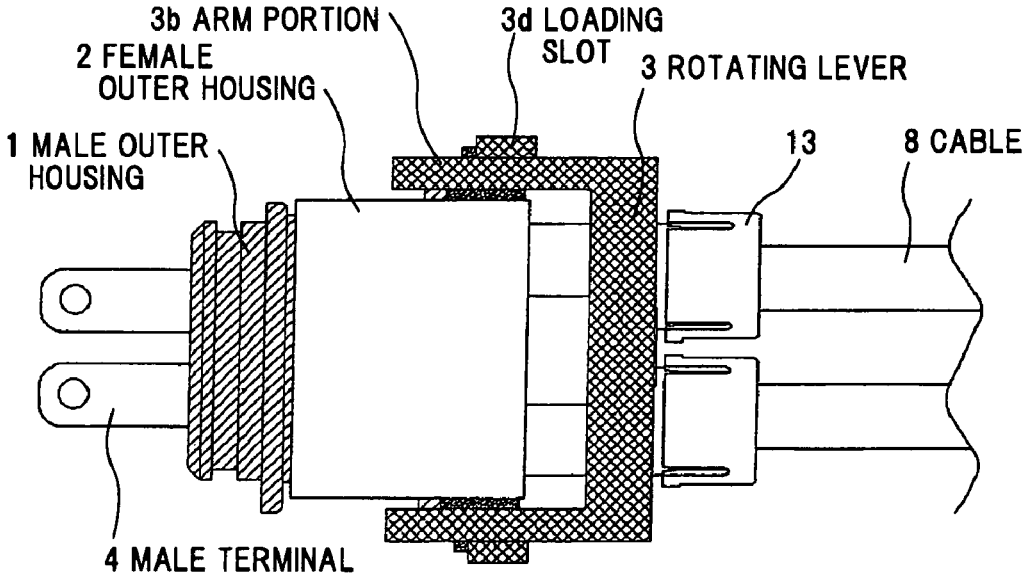
FIG. 3B is a top view showing the state of the lever lock type connector of FIG. 1 after joining the male and female outer housings together.

FIGS. 3A and 3B show the connector after the joining, where FIG. 3A is a side view and FIG. 3B is a top view. In joining the connector, the engaging projection 1*a* provided on the male outer housing 1 is inserted into the loading slot 3*d* of the rotating lever 3 for temporarily fitting the outer housings 1 and 2. Then, the engaging projection 1*a* moves along the groove portion 3*a* by turning the rotating lever 3 toward the side of the cable 8 (clockwise in FIG. 3A), which results in that the outer housings 1 and 2 are completely fitted. As shown in FIG. 2A, the loading slot 3*d* is connected to the groove portion 3*a*.

After joining the connector, the rotating lever 3 is fixed to a connector position assurance (CPA) 14 on the female outer housing 2. Thereby, the joining state of the connector can be maintained.

The connecting member 11 will be detailed below referring to FIG. 4 and FIG. 5, where an axial direction along which the arm portions 3*b* in FIG. 3B are opposed is defined as a connector width direction, and a direction perpendicular to both of the connector joining direction and the connector width direction is defined as a connector height direction.

Figure 4:
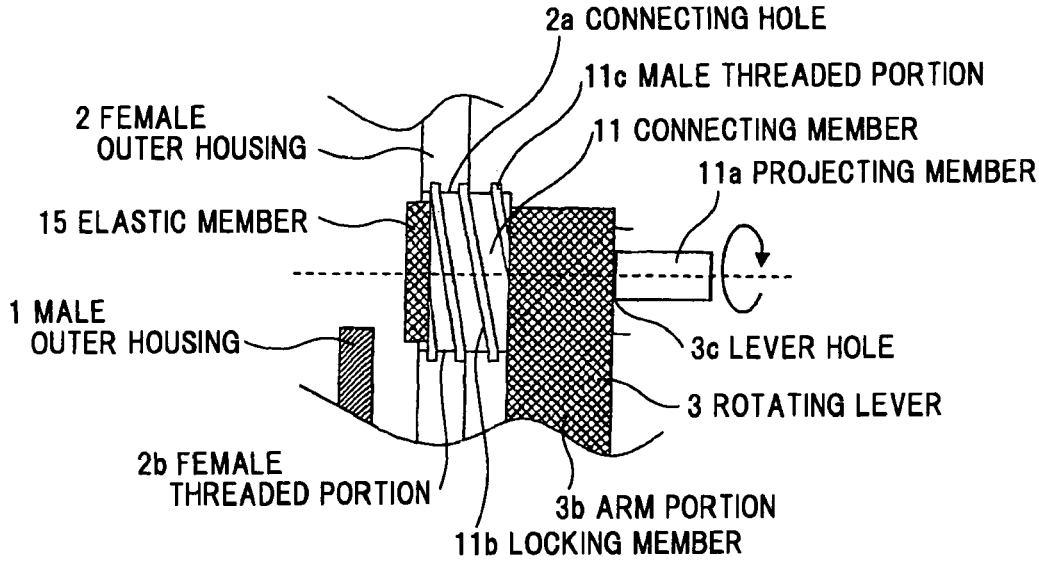
FIG. 4 is an enlarged top view showing a periphery of a connecting member in the lever lock type connector of FIG. 1 before the joining.

FIG. 4 shows an enlarged top view of the periphery of the connecting member 11 before the joining. FIG. 5 shows an enlarged top view of the periphery of the connecting member 11 after the binding. The connecting member 11 includes the projecting member 11*a* and the locking member 11*b*, and the locking member 11*b* is provided with an elastic member 15 at a part contacting the male outer housing 1.

A male threaded portion 11*c* is formed on a curved surface portion of the locking member 11*b* and a female threaded portion 2*b* screwing together to the male threaded portion 11*c* is formed on an inner sidewall of a connecting hole 2*a* penetrating through the female outer housing 2. In this structure, the locking member 11*b* provided for the connecting member 11 rotates (in direction of the arrow in FIG. 4) while the male threaded portion 11*c* is screw-contacting the female threaded portion 2*b* of the connecting hole 2*a* in conjunction with the rotating operation of the rotating lever 3 (in direction of the arrow in FIG. 4), and moves in the connector width direction of the male outer housing 1. Then, as shown in FIG. 5, the elastic member 15 contacts the both sidewalls of the male outer housing 1 being inserted into the female outer housing 2 when joining the housings 1 and 2, so that the outer housings 1 and 2 can be locked with each other. Meanwhile, it is preferable that the elastic member 15 contacts the sidewall to push the male outer housing 1 in the connector width direction.

Figure 5:
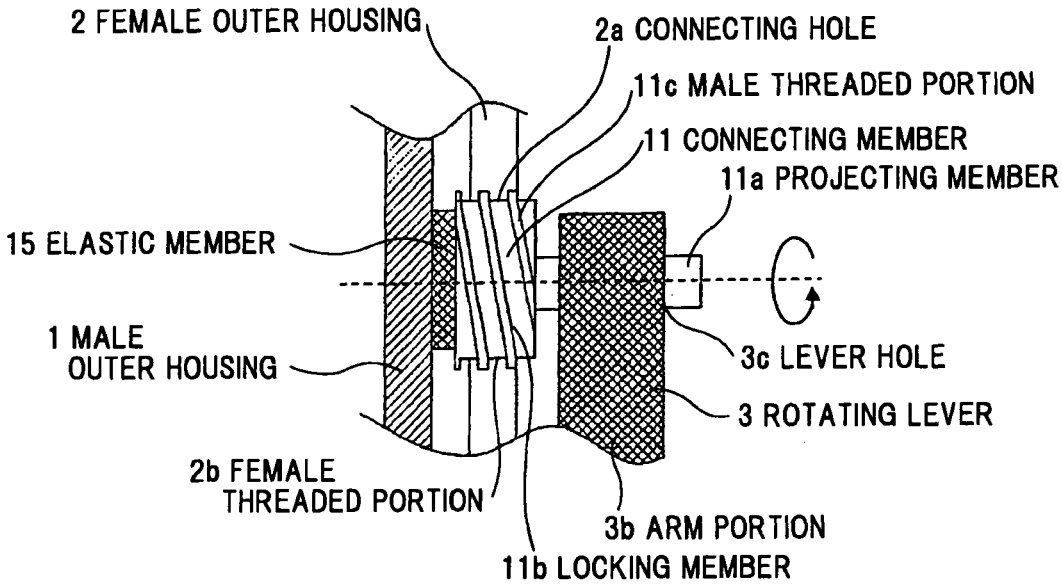
FIG. 5 is an enlarged top view showing a periphery the connecting member in the lever lock type connector of FIG. 1 after the joining.

In releasing the locked outer housings 1 and 2, the rotating lever 3 is turned from the state shown in FIG. 5 in the opposite direction to the joining operation. Thereby, the locking member 11*b* provided on the connecting member 11 rotates in the opposite direction (i.e., in the direction of the arrow in FIG. 5) while the male threaded portion 11*c* is screw-contacting the female threaded portion 2*b* in the connecting hole 2*a*. Then, the elastic member 15 moves away from the sidewalls of the male outer housing 1 being inserted into the female outer housing 2, so that the locking of the outer housings 1 and 2 can be released.

According to the lever lock type connector 20 of this embodiment, the connecting member 11 contacts the sidewalls of the male outer housing 1 in accordance with the rotating operation of the rotating lever 3. Thus, similarly to the joining operation of the conventional lever lock type connector, by only turning the rotating lever 3, it is possible to surely prevent backlash caused by vibration of an automotive engine or the like in the direction orthogonal to the connector joining direction between the outer housings 1 and 2.

Therefore, it is possible to reduce abrasion caused by vibration at the contact portion between the male terminal 4 and the female terminal 6. Namely, it is possible to improve the vibration resistance of the lever lock type connector 20 without changing operability for joining the housings 1 and 2.

In the lever lock type connector 20 of this embodiment, it is preferable to use an elastic material (with Young's modulus of about 1.5 to 5.0 MPa) such as a rubber as the elastic member 15 provided between the connecting member 11 and the male outer housing 1. Thereby, even when the locking member 11*b* pushes and presses the male outer housing 1 with a strong force, any scratch or deformation is less likely to occur on the locking member 11*b* and the male outer housing 1 so that the reliability can be enhanced.

Furthermore, since a large frictional resistance is provided between the elastic member 15 and the male outer housing 1, it is possible to prevent the backlash between the outer housings 1 and 2 caused by vibration of the automotive engine or the like. Thereby, it is possible to prevent a rubbing between the male terminal 4 and the female terminal 6 provided inside the outer housings 1 and 2. Thus, the vibration resistance of the lever lock type connector 20 can be enhanced.

In the lever lock type connector 20 of this embodiment, the rotating lever 3 after joining the outer housings 1 and 2 is fixed at a certain position for the connector joining by the connector position assurance (CPA) 14 provided on the female outer housing 2. Therefore, the rotating lever 3 does not shift from the position for the connector joining even under vibration generated from the automotive engine or the like. Thereby, the connecting member 11 in conjunction with the rotating operation of the rotating lever 3 is fixed at the position that it contacts the male outer housing 1 when the connector has been joined. Therefore, the locking of the outer housings 1 and 2 can be surely held. The backlash between the outer housings 1 and 2 in the joined connector can be prevented even under the vibration generated from the automotive engine or the like. Therefore, it is possible to prevent the rubbing between the male terminal 4 and the female terminal 6 provided inside the outer housings 1 and 2. Thus, the vibration resistance of the lever lock type connector 20 can be enhanced.

Second Embodiment

The second preferred embodiment according to the present invention will be explained in detail referring to FIG. 6A to FIG. 7B.

Figure 6A:
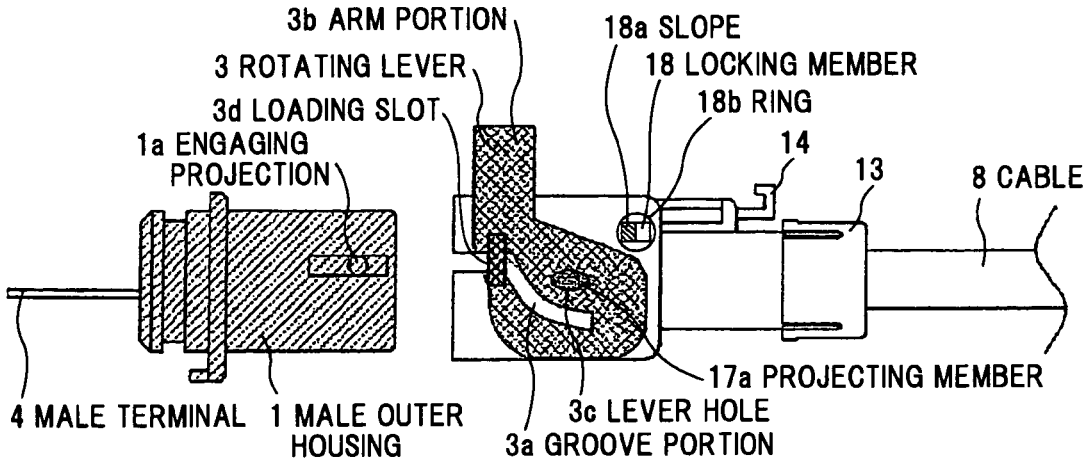
FIG. 6A is a side view showing a lever lock type connector in a second preferred embodiment according to the present invention before the joining.

FIG. 6A shows a side view of the lever lock type connector of the second embodiment before the connector joining. In the first embodiment, the connecting member 11 for ratably connecting the rotating lever 3 to the female outer housing 2 is integrated with the locking member 11*b* for locking the outer housings 1 and 2. In the second embodiment, a connecting member 17 for rotatably connecting the rotating lever 3 to the female outer housing 2 is separated from a locking member 18 for locking the outer housings 1 and 2. The other components are the same as the first embodiment.

Figure 6B:
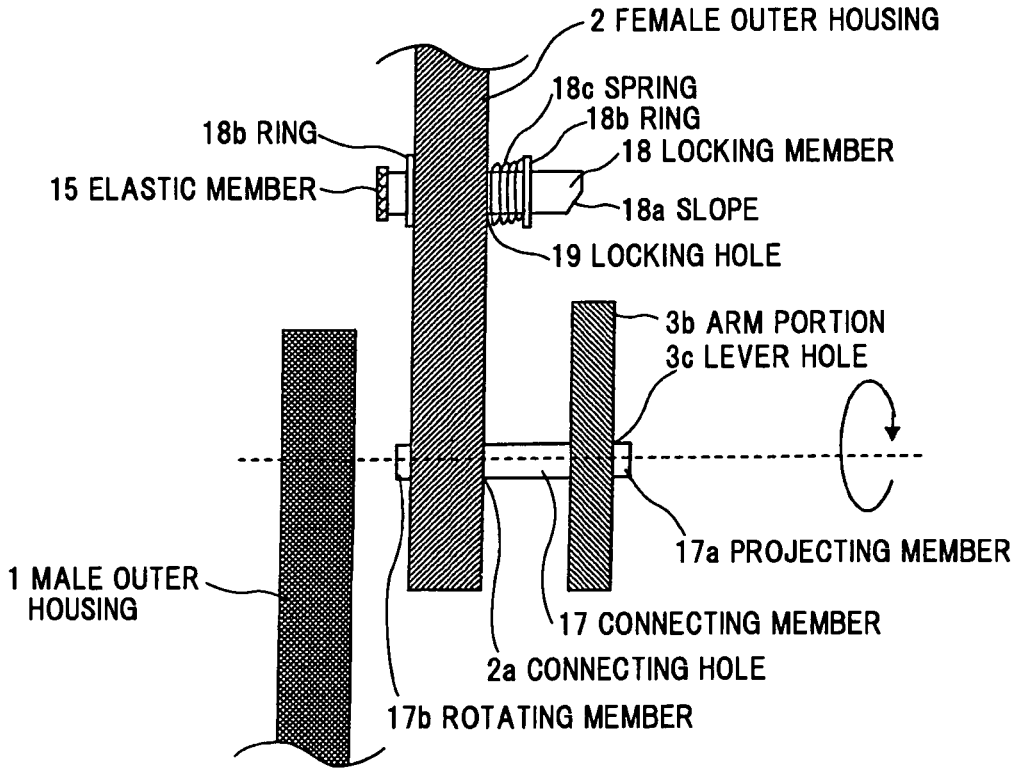
FIG. 6B is an enlarged top view showing a periphery of a locking member in the lever lock type connector in the second embodiment before the joining.

Following is a detailed explanation for the connecting member 17 and the locking member 18 which are distinctive in the second embodiment. FIG. 6B shows an enlarged top view of a periphery of the locking member 18 before joining the connector.

A projecting member 17*a* is integrally formed at an end of the connecting member 17 and a rotating member 17*b* is integrally formed at another end thereof. The projecting member 17*a* is formed elliptical in section and fitted into the elliptical lever hole 3*c* provided on the arm portion 3*b*, so that the connecting member 17 is fixed to the rotating lever 3.

The rotating member 17*b* is rotatably supported by the connecting hole 2*a* penetrating through the sidewall of the female outer housing 2. Thus, the connecting member 17 is rotatably supported by the female outer housing 2 when turning the rotating lever 3.

Meanwhile, the projecting member 17*a* and the lever hole 3*c* are not limited to the elliptical shape, and they may be arbitrarily formed if only the connecting member 11 can be rotated in accordance with the rotating operation of the rotating lever 3. In other words, the projecting member 17*a* only has to be fixed to or interlocked with the lever hole 3*c*, and it may be fixed thereto by an adhesive or welding.

The locking member 18 formed separately from the connecting member 17 is formed a substantially square pole and inserted into a locking hole 19 penetrating through the female outer housing 2 to be movable in the direction of the lateral side of the male outer housing 1. A pair of rings 18*b* having a diameter larger than that of the locking hole 19 are formed on the side of the male outer housing 1 and the rotating lever 3, respectively, of the locking member 18 sandwiching the female outer housing 2. A spring 18*c* is disposed between the ring 18*b* on the side of the rotating lever 3 and the female outer housing 2. Thus, the locking member 18 is movable in the sidewall direction of the male outer housing 1 by a distance between the pair of rings 18*b*. Furthermore, a slope 18*a* is formed at one end on the side of the rotating lever 3 of the locking member 18.

In this structure, the arm portion 3*b* contacts the slope 18*a* of the locking member 18 according as the rotating lever 3 rotates in the direction of the arrow in FIG. 6. Thereby, the slope 18*a* is pushed by the arm portion 3*b* so that the locking member 18 moves toward the sidewall of the male outer housing 1.

According to the movement of the locking member 18, the spring 18*c* provided on the locking member 18 is shrunk between the female outer housing 2 and the ring 18*b*.

Meanwhile, similarly to the first embodiment, the locking member 18 may be provided with the elastic member 15 at a portion contacting the male outer housing 1. Thereby, even when the locking member 18 pushes and presses the male outer housing 1 with a strong force, any scratch or deformation is less likely to occur on the locking member 18 and the male outer housing 1 so that the reliability can be enhanced. Meanwhile, the locking member 18 is not limited to the square pole in shape and it may be any shapes, such as a cylindrical column, a triangle pole or the like.

Figure 7A:
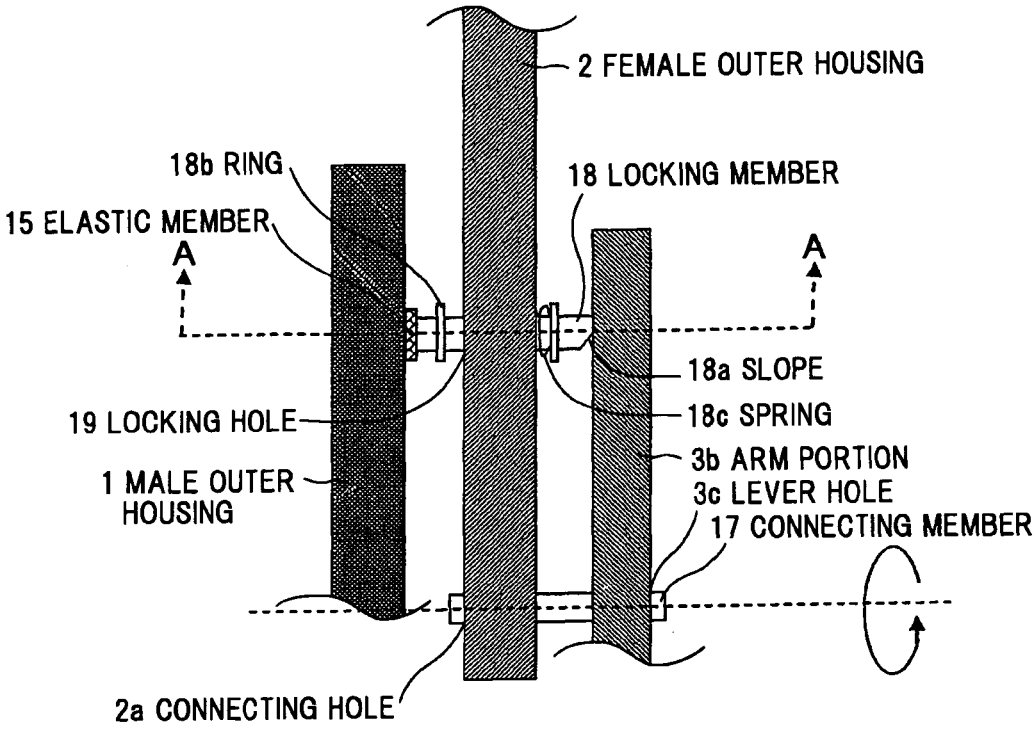
FIG. 7A is a top view showing a periphery of the locking member in the lever lock type connector of FIG. 6A after the joining.
Figure 7B:
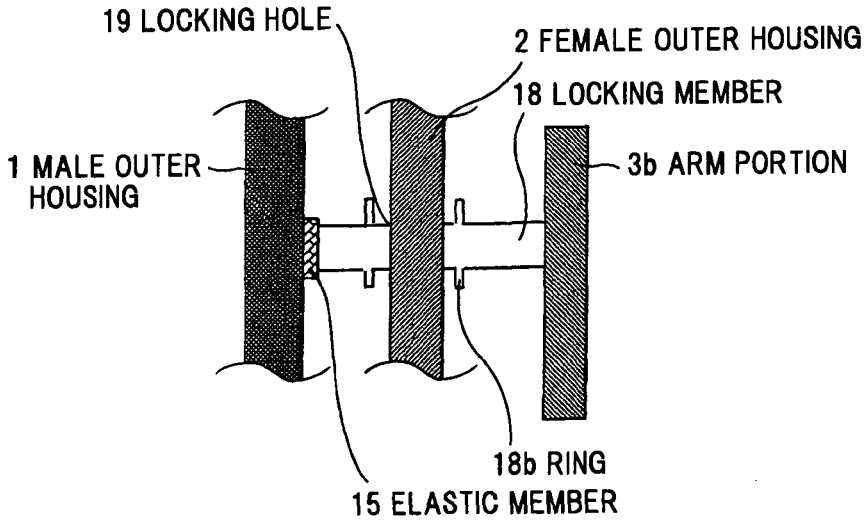
FIG. 7B is a cross sectional view cut along a line A-A in FIG. 7A.
Figure 8:
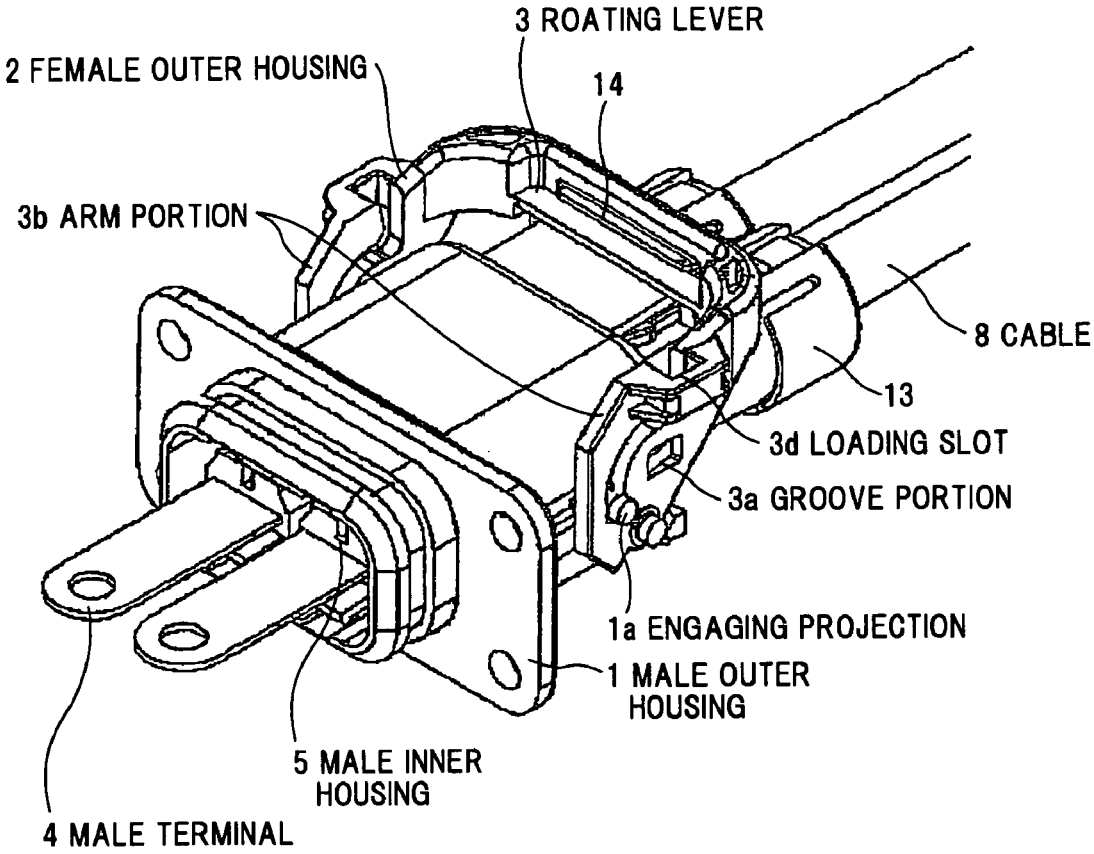
FIG. 8 is a perspective view of the conventional connector.
Figure 9:
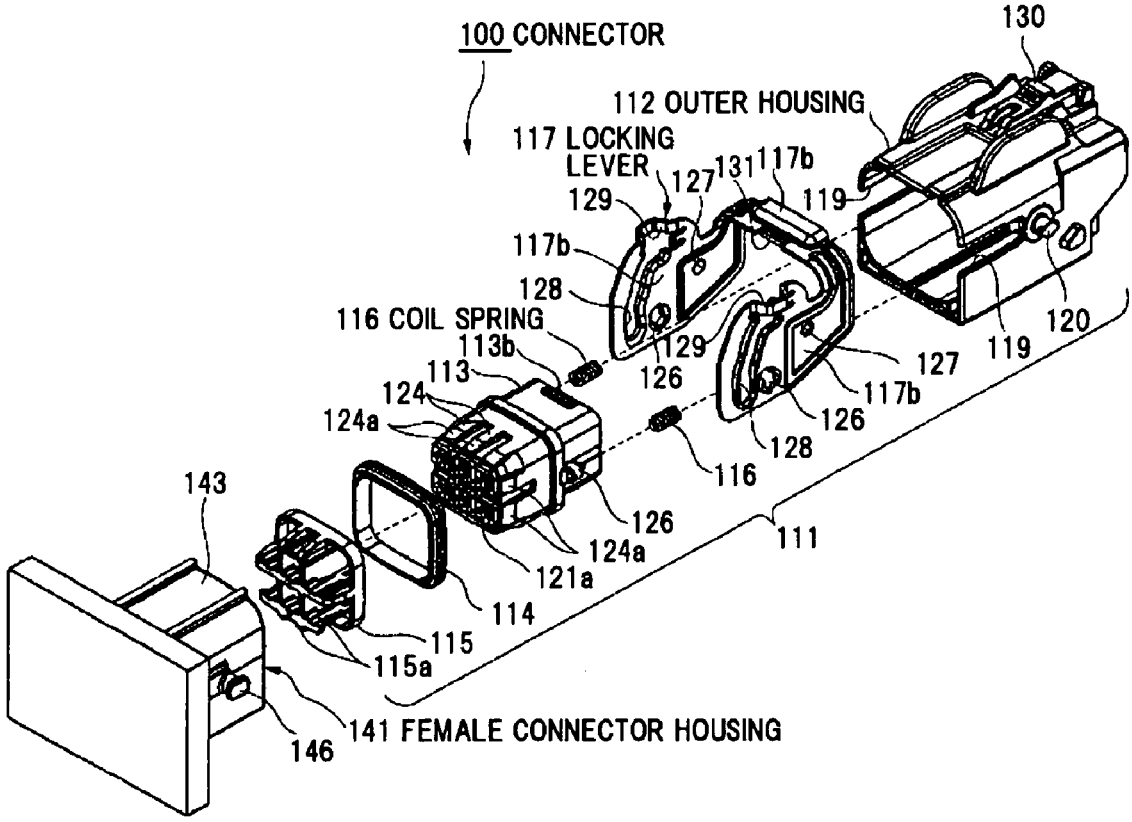
FIG. 9 is an exploded perspective view of the conventional connector.

FIG. 7A is a top view of a periphery of the locking member 18 in the lever lock type connector after the joining. FIG. 7B is a cross sectional view cut along a line A-A in FIG. 7A. The locking member 18 is pushed toward the sidewall of the male outer housing 1 by the arm portion 3*b*, the locking member 18 contacts the sidewall of the male outer housing 1, so that the outer housings 1 and 2 can be locked with each other. It is preferable that the locking member 18 contacts the sidewall to push the male outer housing 1 in the width direction.

In releasing the locked outer housings 1 and 2, the rotating lever 3 is turned in a direction (i.e., in the direction of an arrow in FIG. 7A) opposite to the direction of the joining operation. Since force to push the locking member 18 in the sidewall direction of the male outer housing 1 by the arm portion 3*b* is removed, the locking of the outer housings 1 and 2 can be released. In accordance with the releasing operation, the locking member 18 returns to the position before locking the connector by being biased by the spring 18*c* which is shrunk in the locked state.

According to the lever lock type connector of the second embodiment, similarly to the joining operation of the conventional lever lock type connector, the locking member 18 contacts the sidewalls of the male outer housing 1 by only turning the rotating lever 3. Thereby, it is possible to prevent a backlash between the outer housings 1 and 2 caused by vibration of the automotive engine or the like. Therefore, it is possible to reduce abrasion caused by the rubbing at the contact portion between the male terminal 4 and the female terminal 6. Thus, the vibration resistance of the lever lock type connector 20 can be enhanced without changing operability for joining the connector.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A lever lock type connector, comprising:

a pair of outer housings comprising connecting terminals for an electrical connection, the pair of outer housings being joined each other by a rotating operation of a rotating lever in a state that the rotating lever rotatably supported by one of the pair of outer housings is engaged with an engaging portion of an other of the pair of outer housings; and a locking member that is provided on the one of the pair of outer housings and is movable towards a sidewall of the other of the pair of outer housings, wherein the locking member moves towards the sidewall of the other of the pair of outer housings in conjunction with the rotating operation of the rotating lever to secure the locking member by contacting with the sidewall of the other of the pair of outer housings, when the pair of the outer housings are joined to each other; and wherein the rotating lever is rotatably supported by the one of the pair of outer housings via a connecting member including the locking member, a male threaded portion is formed on a surface of the locking member, a female threaded portion screwing together with the male threaded portion is formed on a connecting hole provided on a sidewall of the one of the pair of outer housings, and the locking member is adapted to be threaded into the connecting hole and to move towards the sidewall of the other of the pair of outer housings in conjunction with the rotating operation of the rotating lever so as to contact the sidewall of the other of the pair of outer housings.

2. The lever lock type connector according to claim 1, wherein:

the connecting member comprises a projecting member integrated therewith, the rotating lever including a lever hole into which the projecting member is inserted, and the projecting member and the lever hole are shaped such that the connecting member rotates in conjunction with the rotating operation of the rotating lever.

3. The lever lock type connector according to of claim 1, wherein:

the locking member comprises an elastic member at a part where it contacts the sidewall of the other of the pair of outer housings.

4. A lever lock type connector, comprising:

a pair of outer housings comprising connecting terminals for an electrical connection, wherein one of the pair of outer housings comprises a rotating lever including a groove portion and is rotatably supported by the one of the pair of the outer housings, an other of the pair of outer housings comprises an engaging projection portion engageable with the groove portion, and the pair of outer housings are joined each other by a rotating operation of the rotating lever in a state that the engaging projection portion is engaged with the groove portion; and a locking member that is provided on the one of the pair of outer housings and is movable towards a sidewall of the other of the pair of outer housings, wherein the locking member moves towards the sidewall of the other of the pair of outer housings in conjunction with the rotating operation of the rotating lever to secure the locking member by contacting with the sidewall of the other of the pair of outer housings, when the pair of the outer housings are joined to each other; and wherein the rotating lever is rotatably supported by the one of the pair of outer housings via a connecting member including the locking member, a male threaded portion is formed on a surface of the locking member, a female threaded portion screwing together with the male threaded portion is formed on a connecting hole provided on a sidewall of the one of the pair of outer housings, and the locking member is adapted to be threaded into the connecting hole and to move towards the sidewall of the other of the pair of outer housings in conjunction with the rotating operation of the rotating lever so as to contact the sidewall of the other of the pair of outer housings.

5. The lever lock type connector according to claim 4, wherein:

the connecting member comprises a projecting member integrated therewith, the rotating lever including a lever hole into which the projecting member is inserted, and the projecting member and the lever hole are shaped such that the connecting member rotates in conjunction with the rotating operation of the rotating lever.

6. The lever lock type connector according to of claim 4, wherein:

the locking member comprises an elastic member at a part where it contacts the sidewall of the other of the pair of outer housings.

* * * * *